US008316889B2

(12) United States Patent
Hoppe et al.

(10) Patent No.: US 8,316,889 B2
(45) Date of Patent: Nov. 27, 2012

(54) CONTROL VALVE FOR A CAMSHAFT ADJUSTER

(75) Inventors: Jens Hoppe, Erlangen (DE); Stefan Konias, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 941 days.

(21) Appl. No.: 12/300,664

(22) PCT Filed: Apr. 25, 2007

(86) PCT No.: PCT/EP2007/054057

§ 371 (c)(1),
(2), (4) Date: Jan. 30, 2009

(87) PCT Pub. No.: WO2007/131866

PCT Pub. Date: Nov. 22, 2007

(65) Prior Publication Data

US 2009/0159829 A1 Jun. 25, 2009

(30) Foreign Application Priority Data

May 13, 2006 (DE) ..... 10 2006 022 402

(51) Int. Cl.
*F16K 11/07* (2006.01)

(52) U.S. Cl. ..... 137/625.68; 137/599.18; 137/614.2; 137/625.69

(58) Field of Classification Search ..... 137/599.18, 137/625.26, 625.68, 625.69, 614.2, 533, 137/533.21, 540, 543.19; 251/337
See application file for complete search history.

(56) References Cited

U.S. PATENT DOCUMENTS

| | | | | |
|---|---|---|---|---|
| 2,879,795 | A * | 3/1959 | Rossman | 137/625.68 |
| 3,131,722 | A * | 5/1964 | Abbott et al. | 137/625.69 |
| 6,209,563 | B1 * | 4/2001 | Seid et al. | 137/625.65 |
| 6,581,634 | B2 * | 6/2003 | Najmolhoda et al. | 137/625.65 |
| 6,640,834 | B1 * | 11/2003 | Hamkins et al. | 137/625.65 |
| 7,367,356 | B2 * | 5/2008 | Berndorfer | 137/614.2 |
| 7,523,728 | B2 * | 4/2009 | Berndorfer | 123/90.17 |
| 7,600,531 | B2 * | 10/2009 | Patze et al. | 137/625.68 |
| 2008/0271689 | A1 * | 11/2008 | Konias et al. | 123/90.17 |
| 2010/0065138 | A1 * | 3/2010 | Hoffmann | 137/597 |

FOREIGN PATENT DOCUMENTS

| | | |
|---|---|---|
| DE | 2413884 | 10/1974 |
| DE | 19853670 | 5/2000 |
| DE | 10143433 | 4/2003 |
| DE | 102005028757 | 1/2007 |
| EP | 1291563 | 3/2003 |
| EP | 1447602 | 8/2004 |
| EP | 102006012775 | 9/2007 |
| JP | 07229408 | 8/1995 |

* cited by examiner

*Primary Examiner* — Craig Schneider
*Assistant Examiner* — Craig J Price
(74) *Attorney, Agent, or Firm* — Volpe and Koenig, P.C.

(57) ABSTRACT

A control valve (14) for a device (1) for modifying the control times of gas exchange valves (110, 111) of an internal combustion engine (100) is provided. A check valve is arranged inside an annular groove (44) which is formed on one of the components of the control valve (14) and through which a pressurized medium flows. This reduces the assembly costs.

8 Claims, 10 Drawing Sheets

CONTROL VALVE FOR A CAMSHAFT ADJUSTER

BACKGROUND

The invention relates to a control valve for a device for variable setting of the control times of gas exchange valves of an internal combustion engine, in particular, according to the preamble of claim 1.

In internal combustion engines, camshafts are used for activating the gas exchange valves. Camshafts are applied in the internal combustion engine in such a way that cams on the camshafts contact cam followers, for example, cup tappets, rocker arms, or valve lifters. If a camshaft is set in rotation, then the cams roll on the cam followers that activate, in turn, the gas exchange valves. Through the position and the shape of the cams, both the opening period and also the opening amplitude, as well as the opening and closing times of the gas exchange valves are set. During the activation of the gas exchange valves, the valve springs exert a force on the cams of the camshaft, by which alternating moments act on the camshaft.

Modern engine designs go so far as to construct the valve drive with a variable design. On one hand, the valve stroke and valve opening period should be able to have a variable construction up until the complete shutdown of individual cylinders. For this purpose, designs such as switchable cam followers or electrohydraulic or electrical valve actuators are provided. Furthermore, it has been shown to be advantageous to be able to influence the opening and closing times of the gas exchange valves during the operation of the internal combustion engine. Here, it is especially desirable to be able to influence the opening or closing times of the intake or exhaust valves separately, in order to set, for example, a defined valve overlap in a targeted way. By setting the opening or closing times of the gas exchange valves as a function of the current characteristic map region of the engine, for example, the current rotational speed or the current load, the specific fuel consumption can be reduced, the exhaust gas behavior can be positively influenced, and the engine efficiency, the maximum torque, and the maximum output can be increased.

The described variability of the gas exchange valve control times is achieved through a relative change in the phase position of the camshaft to the crankshaft. Here, the camshaft is usually in driven connection with the crankshaft via a chain, belt, gear drive or similar acting drive designs. Between the chain, belt, or gear drive driven by the crankshaft and the camshaft there is a device for the variable setting of the control times of gas exchange valves of an internal combustion engine, also called camshaft adjuster below, which transmits the torque from the crankshaft to the camshaft. Here, this device is constructed so that, during the operation of the internal combustion engine, the phase position between the crankshaft and camshaft is reliably maintained and, if desired, the camshaft can be rotated in a certain angular range relative to the crankshaft.

In internal combustion engines with separate camshafts for the intake and exhaust valves, these can each be equipped with a camshaft adjuster. Therefore, the opening and closing times of the intake and exhaust gas exchange valves can be shifted in time relative to each other and the valve overlap can be set in a targeted way.

The seat of modern camshaft adjusters is usually located on the drive-side end of the camshaft. The camshaft adjuster, however, can also be arranged on an intermediate shaft, a non-rotating component, or the crankshaft. It is made from drive wheel driven by the crankshaft and holding a fixed phase relationship relative to the crankshaft, a driven element in drive connection with the camshaft, and an adjustment mechanism transmitting the torque from the drive wheel to the driven element. The drive wheel can be constructed in the case of a camshaft adjuster not arranged on the crankshaft as a chain, belt, or gear wheel and is driven by a chain, belt, or gear drive from the crankshaft. The adjustment mechanism can be operated electrically, hydraulically, or pneumatically.

Two preferred embodiments of hydraulically adjustable camshaft adjusters represent the so-called axial piston adjuster and the rotary piston adjuster.

For the axial piston adjusters, the drive wheel is in connection with a piston and this is in connection with the driven element via helical gearing. The piston separates a hollow space formed by the driven element and the drive wheel into two pressure chambers arranged axial to each other. Now, if one pressure chamber is charged with pressurized medium, while the other pressure chamber is connected to a tank, then the piston shifts in the axial direction. The axial shift of the piston is converted by the helical gearing into a relative rotation of the drive wheel to the driven element and thus the camshaft to the crankshaft.

The so-called rotary piston adjusters are a second embodiment of the hydraulic camshaft adjuster. In this embodiment, the drive wheel is locked in rotation with a stator. The stator and the driven element (rotor) are arranged concentric to each other, wherein the rotor is connected with a non-positive fit, a positive fit, or material fit, for example, by an interference fit, a screw connection, or a weld connection to a camshaft, an extension of the camshaft, or an intermediate shaft. In the stator, several recesses spaced in the peripheral direction are formed that extend radially outward starting from the rotor. The recesses are limited in a pressure-tight manner in the axial direction by a side cover. In each of these recesses, a vane connected to the rotor extends, by which each recess is divided into two pressure chambers. Therefore, two groups of pressure chambers are formed. Through the targeted connection of a group of pressure chambers with a pressurized medium pump and the other group of pressure chambers with a tank, the phase of the camshaft relative to the crankshaft can be set or maintained. The vanes can be constructed, for example, in one piece with the rotor or as separate components that are arranged in an axial vane groove on the outer lateral surface of the rotor and can be forced radially outward by a spring element.

For controlling the camshaft adjuster, sensors detect the characteristic data of the engine, such as, for example, the current phase position of the camshaft relative to the crankshaft, the load state, and the rotational speed. This data is fed to an electronic control unit that, after comparison of the data with a characteristic data map of the internal combustion engine, controls the inflow and outflow of pressurized medium to the different pressure chambers.

In order to adjust the phase position of the camshaft relative to the crankshaft, in hydraulic camshaft adjusters one of the two counteracting pressure chambers is connected to a pressurized medium pump and the other is connected to the tank. The supply of pressurized medium to one chamber in connection with the discharge of pressurized medium from the other chamber shifts the piston/vane separating the pressure chambers, by which the camshaft is rotated relative to the crankshaft in axial piston adjusters by an axial shift of the piston by the helical gearing. In rotary piston adjusters, through the pressurization of one group of pressure chambers and the depressurization of the other group of pressure chambers, the vane is shifted in the peripheral direction and thus directly rotates the camshaft relative to the crankshaft. In order to maintain the phase position, both pressure chambers are either connected to the pressurized medium pump or both are separated from the pressurized medium pump and also from the tank.

The control of the pressurized medium flows to or from the pressure chambers is realized by a control valve, usually a 4/3 proportional valve. This is made essentially from a hollow cylindrical valve housing, a control piston, and an adjustment unit. The valve housing is provided with a connection for each group of similarly acting pressure chambers (working connection), a connection for the pressurized medium pump, and at least one connection to a tank. These connections are usually constructed as annular grooves on the outer lateral surface of the valve housing that communicate via radial openings with the interior of the control piston. With the valve housing, the control piston is arranged so that it can move in the axial direction. The control piston can be positioned by a control unit that is usually activated electromagnetically or hydraulically against the spring force of a spring element in the axial direction into any position between two defined end positions. The outer lateral surface of the control piston is essentially adapted to the inner diameter of the valve housing and provided with annular grooves and control edges. By controlling the control unit, the individual connections can be connected to each other hydraulically, by which the individual pressure chambers can be connected selectively to the pressurized medium pump or the tank. Likewise, a position of the control piston can be provided in which the pressurized medium chambers are separated both from the pressurized medium pump and also from the pressurized medium tank.

Such a control valve is known from JP 07-229408A. In this case, five annular grooves spaced in the axial direction relative to each other are formed on the outer lateral surface of the valve housing, wherein each of the annular grooves is used as a connection of the valve. In each groove base of the annular grooves, a radial opening is formed that opens into the interior of the valve housing. Here, openings of adjacent groove bases are offset in the peripheral direction by 180° relative to each other. Within the valve housing, a solid control piston is arranged that can be positioned by an electromagnetic control unit between two end stops against the force of a spring within the valve housing in the axial direction. The outer diameter of the control piston is adapted to the inner diameter of the valve housing. In addition, on the control pistons three annular grooves are formed by which adjacent connections can be connected to each other as a function of the position of the control piston relative to the valve housing.

From DE 198 53 670 A1, another embodiment of such a control valve is known. This differs from the embodiment shown in JP 07-229408A in that the control piston has a hollow construction. In addition, on the outer lateral surface of the valve housing there are only three connections, wherein a fourth connection is formed in the axial direction of the valve housing. Pressurized medium can now be led via the axial supply connection, according to the position of the control piston relative to the valve housing, to one of the two working connections. Simultaneously, the other working connection is connected to the tank connection by an annular groove formed on the outer lateral surface of the control piston. In this embodiment of a control valve, the position of the supply connection and the tank connection is exchangeable.

Through the rolling of the cams of a camshaft on the cam follower of a valve drive, periodic alternating moments act on the camshaft. These alternating moments are transmitted to the rotor of the camshaft adjuster, by which pressure spikes are produced in the pressure chambers. In order to prevent these pressure spikes from being transmitted via pressurized medium lines and the control valve into the pressurized medium circuit of the internal combustion engine, check valves are provided between the control valve and the pressurized medium pump. Here, check valves that are separate or integrated in the control valve are provided.

A check valve integrated in the control valve is shown, for example, in EP 1 291 563 A2. In this embodiment, within an annular groove formed on a valve housing there is a closing element made from a strip bent into a ring. The annular groove is defined in the radial direction by a sleeve. Both in the sleeve and also in the groove base of the annular groove there are openings by which the pressurized medium can reach into the interior of the valve housing. In addition, the strip is made from an elastic steel and is biased outward in the radial direction. If the pressure in the interior of the valve housing exceeds the pressure of the pressurized medium arriving at the opening of the sleeve, then the strip contacts the inner lateral surface of the sleeve and thus prevents the pressurized medium flow from the interior of the valve housing to the opening of the sleeve. Conversely, the strip is deformed inward by the pressurized medium arriving at the opening of the sleeve, by means of which pressurized medium can lead from the opening of the sleeve into the interior of the valve housing.

The invention is based on the objective of providing an alternative construction of a control valve for a camshaft adjuster with an integrated check valve.

SUMMARY

According to the invention, the objective is met by the features of the independent claim 1. Additional constructions of the invention emerge accordingly from the features of the dependent claims 2 to 8.

According to the invention, a closing body that has at least one guide element and also one blocking body is provided in the check valve. Here, the guide element of the one guide of the closing body is used during the movement between an opening and a closing position of the closing body. The guide element, for example, a guide surface, can be in constant sliding contact with adjacent components, such as the control piston or the valve housing, during such closing movement or can become active only after overcoming play perpendicular to a guide direction. The guide element can have an arbitrary construction, in particular, as a sliding or rolling contact.

According to the invention, the guide element and blocking body are coupled to each other in such a way that the guide element and the blocking body are moved in common. This means that guide forces generated in the region of the guide element can be transmitted to the closing body, so that, in the end, care is also taken that the blocking body is adequately guided. In particular, the guide element and blocking body are moved between opening and closing positions as a rigid body, wherein additional components of the closing body can be deformed elastically. It is also possible that the movement of the guide element and blocking body are coupled with each other rigidly in the opening and closing direction, while elastic deformations are possible perpendicular to the closing direction.

Different from this configuration, according to EP 1 291 563 A2, the closing body that is formed in this case as a strip bent into an annular is an elastic endless body in which, without a sliding or rolling guide movement, the movement of the closing body accompanies an elastic deformation of this body in the opening and closing direction. It is problematic for such a construction that due to the acting forces and a desired opening characteristic, the elastic characteristic parameters of the annular strip are already given. In addition, the strip also forms a sealing surface with the opening in the closing position for which, under some circumstances, other requirements apply to mechanical characteristic parameters of the strip, such as the stiffness. For example, the strip must be in contact around the entire peripheral surface of the opening for the effective pressure relationships. Entry of the strip into the opening due to elastic deformation is also to be avoided like an undesired partial release of the opening across a partial extent of the opening. Further problems can be produced due to the elastic strip for shock-like pressure changes, dynamic flow conditions, for example, with an increasing closing of an annular gap between the strip and the opening. From the mentioned requirements that are different under some circumstances for the construction of the stiffness of the annular strip according to EP 1 291 563 A2, a conflict of goals is produced under some circumstances.

The previously mentioned knowledge is taken into consideration according to the invention in that, on one hand, a coupling between the guide element and the blocking body is realized in such a way that these components are moved in common during the movement of the closing body. In this way there is initially a defined movement behavior for the guide element and blocking body. In addition to the guide element and the blocking body, a spring element is provided that can also be designed separately and can be adapted, in particular, to the desired opening and closing characteristics of the check valve. The spring element here pressurizes the closing body in the radial direction in the direction of the closing position, so that with a drop in the pressure difference on both sides of the closing body, the closing position is assumed as the "default" position.

The scope of the invention is not left when not just the spring element is responsible for a closing movement, but instead forces for creating a closing position are supported by static or dynamic hydraulic conditions on the active surfaces of the closing body.

It is furthermore noted that the construction according to the invention that the guide element and blocking body are coupled rigidly to each other is not absolutely necessary. Also conceivable is an elastic coupling of the guide element and blocking body, wherein in each case a movement of the guide element correlates with a movement of the blocking body, under some circumstances, however, with different magnitudes.

The spring element according to the invention can involve an arbitrary spring element, in particular, a spring element made from a spring steel, a compression and/or tensile spring, a spiral spring, a spring made from a composite material, an elastomer spring element, a spring element with integrated damping element, a linear or non-linear spring, a spring formed with steel or another material with lower inherent friction, a helical spring, a torsion spring, a leaf spring, a plate spring, an annular spring, a worm spring, a rolling spring, a sleeve spring, a slotted spring, a coiled spring with cylindrical or conical winding or flat winding, a torsion spring with a torsion bar or tube, a leaf spring, a plate spring, a deep-drawn disk spring, an annular spring, a spring made from plastic or rubber with or without gas or a fluid filling, a composite spring of rubber-metal, a spring made from fiber-reinforced plastic, a spring with hollow spaces or openings, projections, stops, ribs, spikes on at least one surface, a spring with an elastic material between a rigid outer sleeve and a rigid inner sleeve or a rigid inner block, a spring unit made from several individual spring elements of the same or different materials and/or type of construction, a fluid spring. Also possible is the combination of several identical or different springs of the types named above in a mechanical series or parallel connection to form a spring element.

An especially simple construction of the invention is given when the spring element is an integral component of the closing body. Such a spring element is especially simple to produce together with the closing body, through which the number of components is reduced and, under some circumstances, the weight can be reduced. For example, the closing body with the integrally formed spring element can involve a molded or injection-molded part made from an elastic plastic. The use of a composite body, for example, with a spring steel coated with plastic, is also possible.

According to another embodiment of the invention, the closing body has a U-shaped construction to a first approximation and has a base leg and two parallel side legs. Here, the base leg can be curved and can have an outer surface that is adapted to the surface of contours of the recess of the housing for holding the control piston or is adapted at least to the defining contours of the opening. In this way, the base leg can form the blocking body in a simple way. Simultaneously, at least one side leg can be used as a guide element that contacts a guide surface of the control piston in a guiding way. For example, the side leg thus extends in the opening and closing direction, so that the guide direction can be defined with this leg in a simple way.

For the case that a relatively rigid material is selected, in principle, for the blocking body and possibly also for the guide element, a desired closing effect that the blocking body contacts uniformly over the entire boundary of the opening is required, because otherwise undesired leakage would occur. In the extreme case, this also means that a guide of the closing body must be performed exactly vertical to the boundary of the opening. The desired closing effect can be guaranteed or reinforced reliably and in a simple way such that an elastic sealing element is formed by the closing body in the region of the blocking body or the base leg. Such a sealing element can involve an additional component mounted on the base leg, such as a sealing body that is attached, for example, with a material fit to the base leg. Also possible is a coating of the base leg with an elastic material. For such a construction, a reliable closing position can also be guaranteed, e.g., when the closing movement is not guided exactly as explained above due to tolerances or wear. The elastic sealing element can be increasingly pressurized when the closing position is reached, wherein at least one part of the pressurization of the elastic sealing element is generated by the spring element.

For the preparation of the spring element, an especially compact construction is produced when a spring bar projects from the base leg of the closing body on the inside at an acute angle. This spring bar is loaded elastically under reduction of the mentioned acute angle. An end region of the spring bar can be supported elastically opposite the control piston. In addition to the compact construction, such a construction has the advantage that the spring element formed as a spring bar can be surrounded in a cross section by the control piston, the side legs, and the base leg, so that a certain protective effect is given for the spring element.

The closing body can have a tab that is advantageously also formed integrally with the other components of the closing body for guaranteeing another function in an end region of the side leg opposite the base leg. Such a tab can form a lock or a stop with the control piston, by means of which, for example, an end position of the closing body is set and/or a mounting aid can be given that prevents unintentional detachment of the closing body from the control piston.

Another function can be taken over by the side legs when these have at least one through-flow opening through which pressurized medium can pass in the opening position of the closing body.

Advantageous improvements of the invention emerge from the claims, the description, and the drawings. The advantages named in the introduction for features and combinations of several features are merely examples and these do not have to be absolutely realized by embodiments according to the invention. Additional features are to be taken from the drawings—in particular the illustrated geometries and the relative dimensions of several components relative to each other and also their relative arrangement and active connection. The combination of features of different embodiments of the invention or of features of different claims is also possible deviating from the selected associations of the claims and is herewith suggested. This also relates to features that are shown in separate drawings or named in their description. These features can also be combined with features of different claims. Features listed in the claims can also be left out for further embodiments of the invention.

BRIEF DESCRIPTION OF THE DRAWINGS

Additional features of the invention emerge from the following description and the associated drawings in which embodiments of the invention are shown schematically. Shown are.

DETAILED DESCRIPTION OF THE PREFERRED EMBODIMENTS

Figure 1:
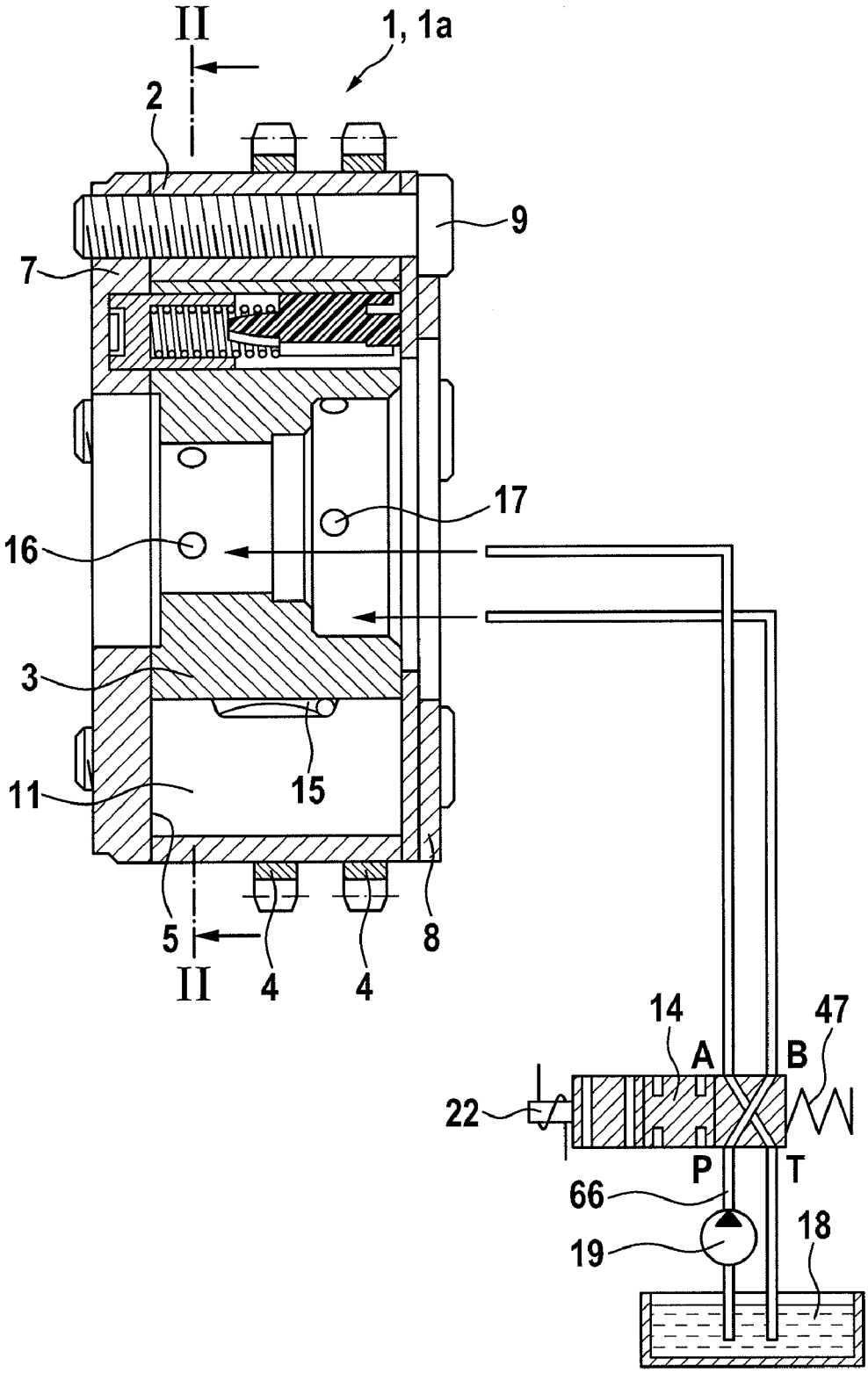
FIG. 1 a longitudinal section view through a device for changing the control times of an internal combustion engine with a pressurized medium circuit, FIG. 2 a cross sectional view through the device shown in FIG. 1 along the line II-II, FIG. 3 a longitudinal section view through a control valve, FIG. 4 a perspective view of a first embodiment of a control valve, FIG. 5 a perspective view of the closing body from FIG. 4, FIG. 6*a* a cross sectional view through the control valve from FIG. 4 in the region of the supply connection that is arranged in a peripheral construction, FIG. 6*b* a cross sectional view analogous to FIG. 6*a*, FIG. 7*a* a cross sectional view through the control valve analogous to FIG. 6*a* with a modified closing body, FIG. 7*b* a cross sectional view through the control valve analogous to FIG. 6*b* with another, modified closing body, FIG. 8 a perspective view of a second embodiment of a control valve, FIG. 9 a perspective, partially sectioned view of the check valve according to FIG. 8, FIG. 10 a perspective view of a control valve according to the invention with a closing body and an integral spring element formed by the closing body in a closing position, FIG. 11 the control valve according to FIG. 10 in a perspective view in an opening position of the closing body, and FIG. 12 another construction of a control valve according to the invention in a perspective view in which a spring element is formed as a spiral compression spring, FIG. 13 a schematic cross sectional view of another embodiment of a control valve according to the invention with a check valve and spring elements arranged on the end in the region of side legs of the closing body, and FIG. 14 a construction of a control valve according to the invention essentially corresponding to FIG. 7*b* with an elastomer spring element arranged between the control piston and a blocking body of the closing body.
Figure 1A:
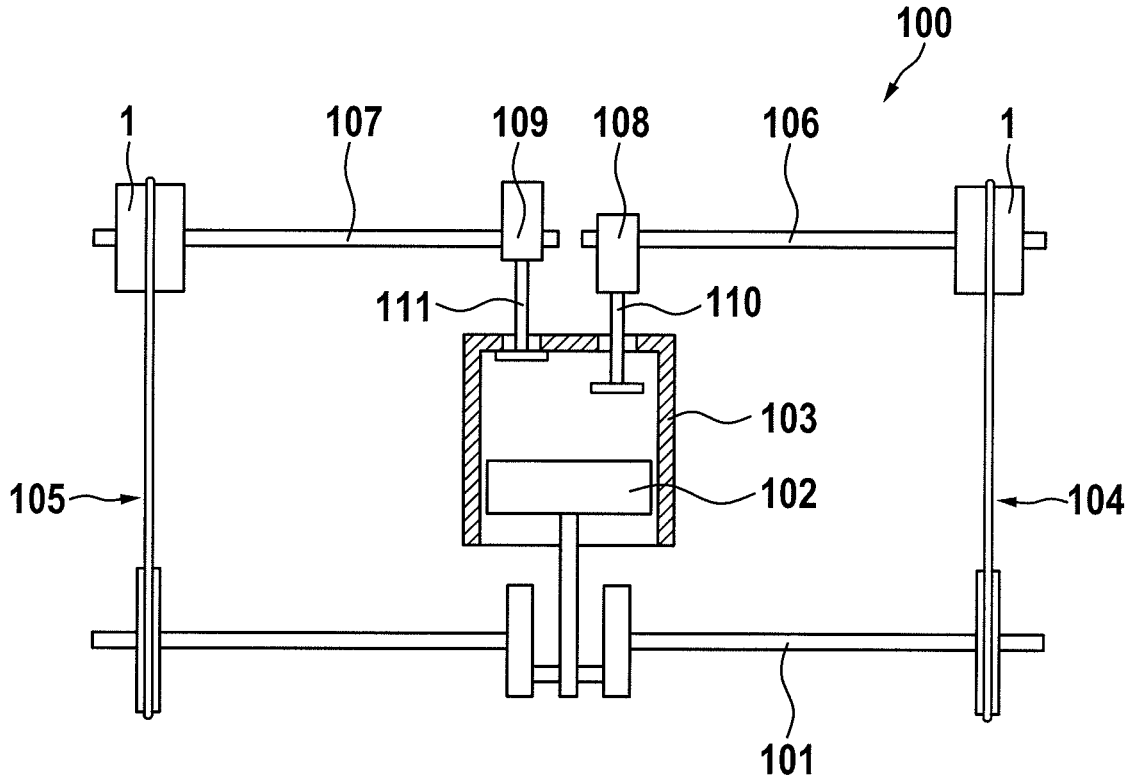
FIG. 1*a* only very schematically an internal combustion engine.

In FIG. 1*a* an internal combustion engine 100 is schematically shown, wherein a piston 102 connected to a crankshaft 101 is shown in a cylinder 103. The crankshaft 101 is in connection in the shown embodiment via a traction mechanism drive 104 or 105 with an intake camshaft 106 or an exhaust camshaft 107, wherein a first and a second device 1 can provide a relative rotation between the crankshaft 101 and camshafts 106, 107 for variable setting of the control times of gas exchange valves 110, 111. Cams 108, 109 of the camshafts 106, 107 activate an intake gas exchange valve 110 or an exhaust gas exchange valve 111. Likewise, only one of the camshafts 106, 107 can be equipped with a device 1 or only one camshaft 106, 107 can be provided that is provided with a device 1.

Figure 2:
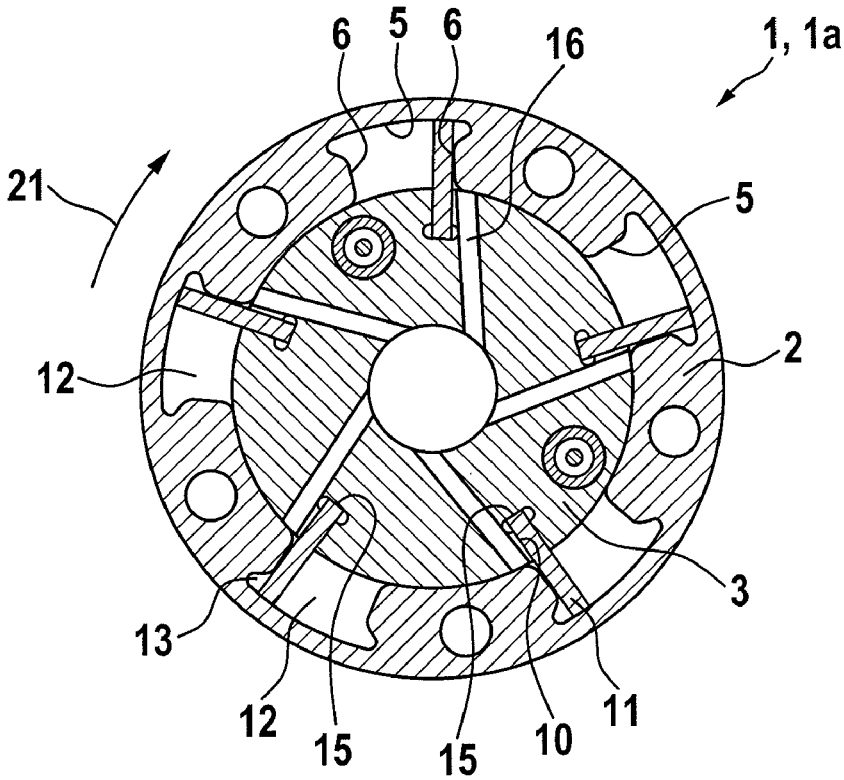

FIGS. 1 and 2 show a hydraulic adjustment device 1*a* of a device 1 for variable setting of the control times of gas exchange valves 110, 111 of an internal combustion engine 100. The adjustment device 1*a* is essentially made from a stator 2 and a rotor 3 arranged concentric to the stator. A drive wheel 4 is locked in rotation with the stator 2 and formed in the illustrated embodiment as a chain wheel. Also conceivable are embodiments of the drive wheel 4 as a belt or gear wheel. The stator 2 is mounted so that it can rotate on the rotor 3, wherein five recesses 5 spaced apart in the peripheral direction are provided on the inner lateral surface of the stator 2 in the illustrated embodiment. The recesses 5 are defined in the radial direction by the stator 2 and the rotor 3, in the peripheral direction by two side walls 6 of the stator 2, and in the axial direction by a first and second side covers 7, 8. Each of the recesses 5 is closed in a pressure-tight manner in this way. The first and the second side covers 7, 8 are connected to the stator 2 by connection elements 9, for example, screws.

Axial vane grooves 10 are formed on the outer lateral surface of the rotor 3, wherein, in each vane groove 10, a radial extending vane 11 is arranged. One vane 11 extends in each recess 5, wherein the vanes 11 contact the stator 2 in the radial direction and the side covers 7, 8 in the axial direction. Each vane 11 divides a recess 5 into two pressure chambers 12, 13 acting opposite each other. To guarantee a pressure-tight contacting of the vane 11 on the stator 2, leaf-spring elements 15 that pressurize the vane 11 in the radial direction with a force are arranged in the vane grooves 10.

Through the use of first and second pressurized medium lines 16, 17, the first and second pressure chambers 12, 13 can be connected by a control valve 14 to a pressurized medium pump 19 or a tank 18. In this way a control drive is formed that allows relative rotation of the stator 2 relative to the rotor 3. The control valve 14 is provided with two working connections A, B that communicate via pressurized medium channels with the pressurized medium lines 16, 17. In addition, a tank connection T and a supply connection P are provided. Through use of the tank connection T, the control valve 14 is connected to a tank 18. The supply connection P is connected to the pressurized medium pump 19 by a pressurized medium line 66. A control unit 22 allows the control valve 14 to be moved into several control positions in which different connections A, B, P, T communicate with each other. Here it is provided that either all of the first pressure chambers 12 are connected to the pressurized medium pump 19 and all of the second pressure chambers 13 are connected to the tank 18 or the exactly opposite configuration. If the first pressure chambers 12 are connected to the pressurized medium pump 19 and the second pressure chambers 13 are connected to the tank 18, then the first pressure chambers 12 expand at the expense of the second pressure chambers 13. From this, the vanes 11 shift in the peripheral direction in the direction shown by the first arrow 21. The movement of the vanes 11 rotates the rotor 3 relative to the stator 2. This results in a phase shift between the camshaft 106, 107 and crankshaft 101. Through targeted supply or discharge of pressurized medium into or out of the pressure chambers 12, 13, the control times of the gas exchange valves 110, 111 of the internal combustion engine 100 can be selectively varied.

In addition, a control position is provided in which both working connections A, B are connected either only to the supply connection P or else neither to the supply P nor to the tank connection T. In this control position of the control valve 14, the relative phase position of the rotor 3 relative to the stator is maintained. In order to prevent pressure spikes produced in the device 1 from reaching the pressurized medium pump 19, a check valve is provided between the pump and the interior of the control valve 14, as still to be described.

Figure 3:
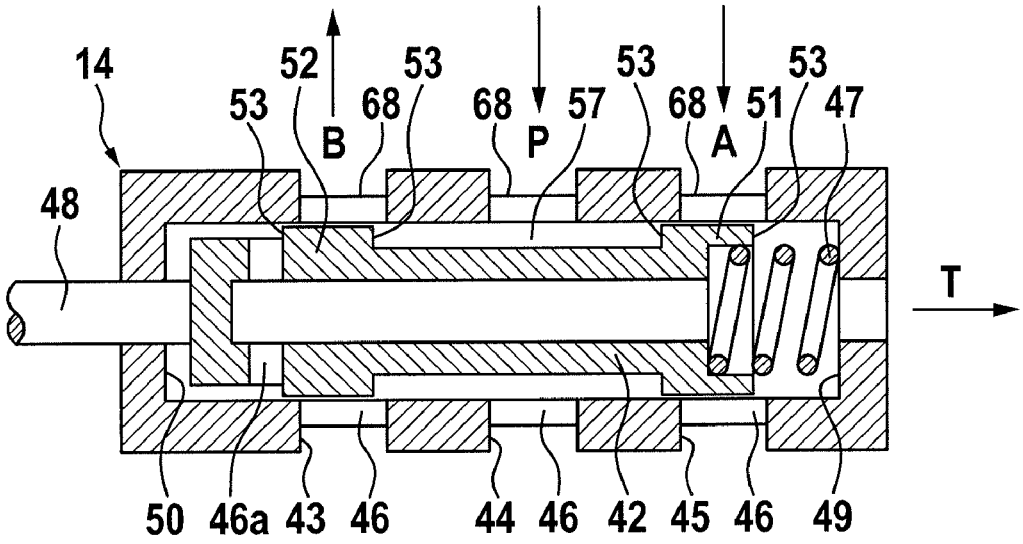

FIG. 3 shows schematically a longitudinal section view through a control valve 14. The control valve 14 is made from a valve housing 41 and a control piston 42. The valve housing 41 has an essentially hollow cylindrical construction with a recess 203, wherein in its outer lateral surface three axially spaced annular grooves 43, 44, 45 are formed. Each of the annular grooves 43 to 45 represents a connection of the control valve 14, wherein the outer (first and third) annular grooves 43, 45 in the axial direction form the working connections A, B and the middle (second) annular groove 44 forms the supply connection P. A tank connection T is constructed by an opening in an end side of the valve housing 41. Each of the annular grooves 43 to 45 is in connection with the interior of the valve housing 41 by the first radial openings 46. Within the valve housing 41 there is a control piston 42 with an essentially hollow cylindrical construction that can move in the axial direction. The control piston 42 is pressurized with a force on one end side by a spring element 47 and on the opposing end face by a push rod 48 of a control unit 22. By energizing the control unit 22, the control piston 42 can be moved against the force of the spring element 47 into any position between a first and a second end stop 49, 50.

The control piston 42 is provided with a first and a second annular bar 51, 52. The outer diameter of the annular bars 51, 52 are adapted to the inner diameter of the valve housing 41. Between the annular bars 51, 52 a fourth annular groove 57 is formed on the control piston 42. Furthermore, second radial openings 46*a* are formed in the control piston 42 between its end at which the push rod 48 engages and the second annular bar 52, by which the interior of the control piston 42 is in connection with the interior of the valve housing 41. The first and the second annular bars 51, 52 are formed and arranged on the outer lateral surface of the control piston 42 in such a way that control edges 53 release or block a connection between the supply connection P and the working connections A, B via the fourth annular groove 57 as a function of the position of the control piston 42 relative to the valve housing 41. At the same time, a connection between the working connections A, B and the tank connection T is released or blocked. By influencing the position of the control piston 42 within the valve housing 41, pressurized medium can be fed selectively to the first or the second pressure chambers 12, 13 and discharged from the other pressure chambers 12, 13, via which the phase position of the camshaft 106, 107 relative to the crankshaft 101 can be changed in a selective way.

Figure 4:
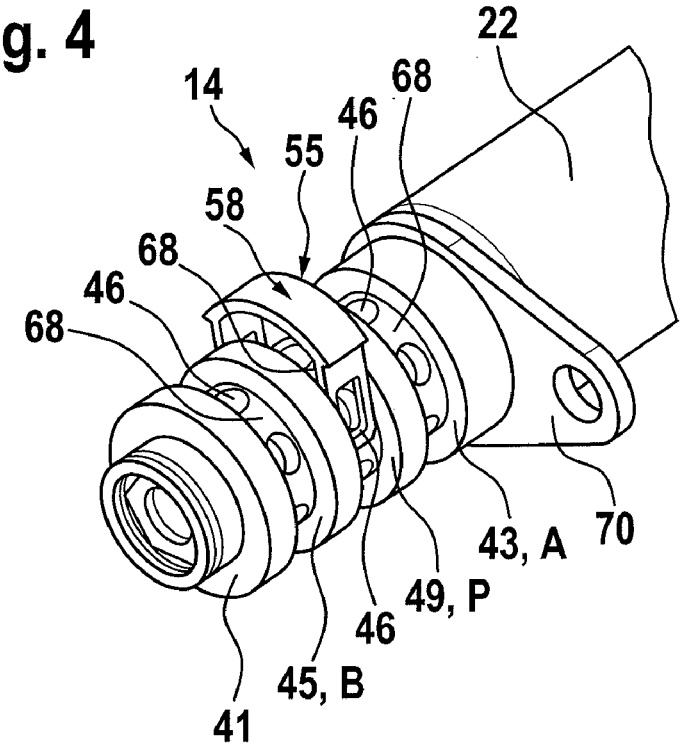

FIG. 4 shows a control valve 14 according to the invention in a perspective diagram. A valve housing 41, a control unit 22, and a closing body 58 of a check valve 54 are shown. The closing body 58 is arranged in the second annular groove 44 and is made from a rigid, only slightly flexible material, for example, a plastic. Between the control unit 22 and the valve housing 41, a mounting flange 70 is provided with a borehole by which the control valve 14 can be mounted on a peripheral construction (not shown in this figure).

Figure 5:
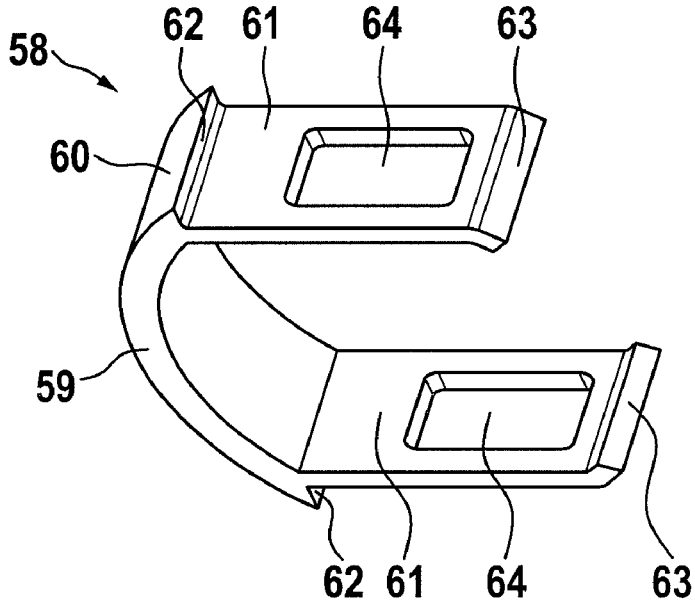

FIG. 5 shows a perspective view of the closing body 58. This is made from a blocking body 59 with a sealing surface 60 and guide elements 61 that are constructed in the shown embodiment as guide bars. In addition, incident-flow surfaces 62 that project past the guide elements 61 are formed on the blocking body 59. Holding elements formed as tabs 63 and through-flow openings 64 are formed on the guide elements 61.

Figure 6A:
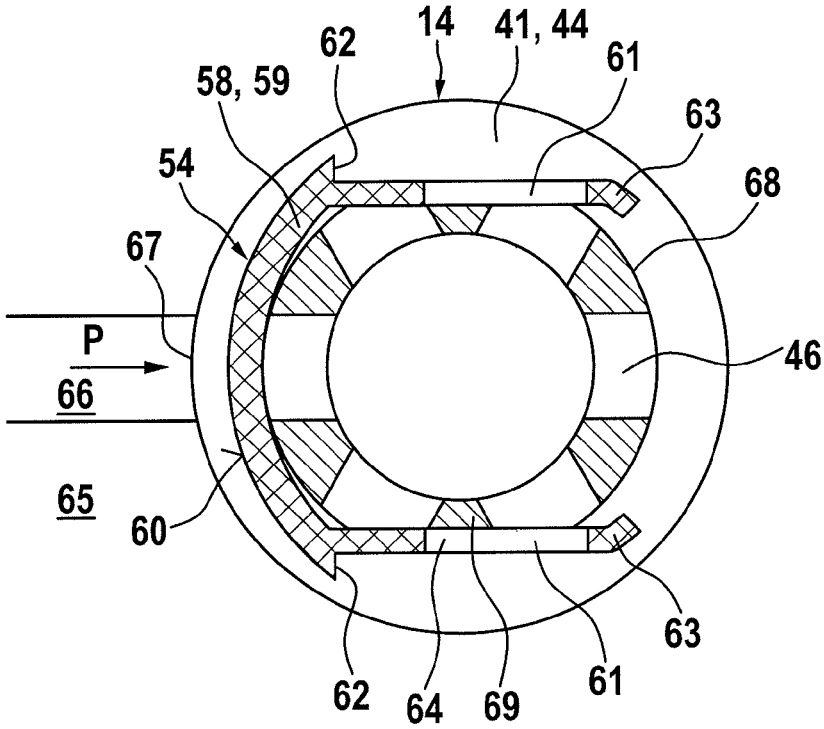
Figure 6B:
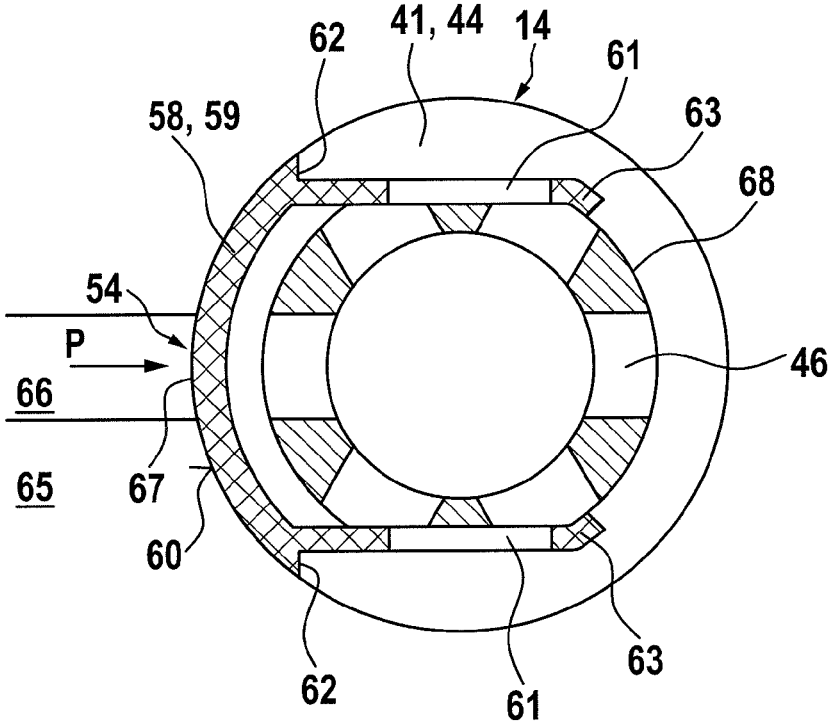

FIGS. 6*a* and 6*b* show a control valve 14 according to the invention, analogous to that shown in FIG. 4, in cross section, wherein the section plane lies in the region of the supply connection P. The control valve 14 is mounted in this diagram in a peripheral construction 65. In the peripheral construction 65 there is a pressurized medium line 66 that connects the second annular groove 44 to a pressurized medium pump (not shown). The pressurized medium line 66 communicates via an opening 67 constructed in the wall of the peripheral construction 65 with the second annular groove 44. The closing body 58 is arranged in the second annular groove 44 such that the sealing surface 60 of the blocking body 59 is oriented in the direction of the opening 67.

The base groove 68 of the second annular groove 44 is provided with two flattened sections 69, wherein these are constructed such that the guide elements 61 formed as guide bars contact the closing body in the mounted state of the closing body 58. The flattened sections 69 are thus used as guide surfaces for the closing body 58. The flattened sections 69 are formed in a defined orientation relative to the borehole of the mounting flange 70. Therefore, these satisfy, on one hand, the function that the closing body 58 is mounted in the correct orientation relative to the opening 67 on the valve housing 41. The mounting flange 70 gives the orientation of the valve housing 41 within the peripheral construction 65 and the flattened sections 69 give the orientation of the blocking body 59 in the second annular groove 44. In addition, the guide elements 61 take over a guide function during the operation of the internal combustion engine 100, by which the closing body 58 can be moved exclusively in the radial direction of the valve housing 41.

In FIG. 6*a*, the check valve 54 is shown in its opened state. Pressurized medium that enters into the second annular groove 44 via the opening 67 force the blocking body 59 and thus the closing body 58 against the groove base 68 of the second annular groove 44. The pressurized medium can now reach into the interior of the valve housing 41 via the second annular groove 44, the through-flow openings 64, and the first radial openings 46.

For the reverse pressurized medium flow from the interior of the valve housing 41 in the direction of the opening 67, the pressurized medium is applied to the reverse side of the blocking body 59 and to the incident-flow surfaces 62. In this way, the closing bodies 58 guided by the guide elements 61 are moved in the direction of the opening 67 until the closing body 58 contacts the wall of the peripheral construction 65. This blocked state of the check valve 54 is shown in FIG. 6*b*. In this state, the opening 67 is blocked by the blocking body 59 and pressure spikes produced in the device 1 cannot advance past the pressurized medium line 66 up to the pressurized medium pump.

In this state of the check valve 54, the tabs 63 contact the groove base 68 of the second annular groove 44. During the transport of the control valve 14, these tabs 63 thus act as a securing device. During assembly, the tabs 63 further ensure that the blocking body 59 does not project past the edge of the second annular groove 44. In this way it is guaranteed that the blocking body 59 is not damaged or even sheared off during the pressing process of the control valve 14 into the peripheral construction 65 and jams the control valve 14 in the peripheral construction 65.

Figure 7A:
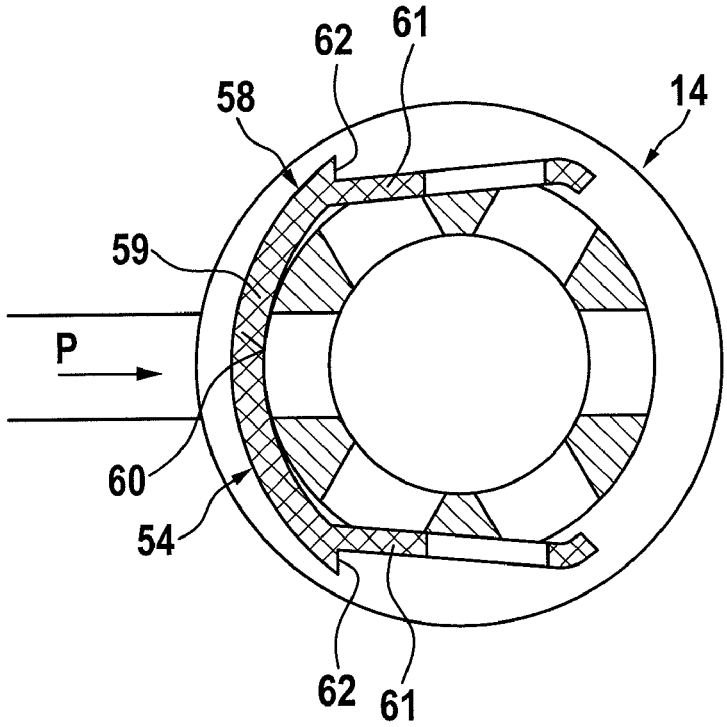

FIG. 7*a* shows a diagram of a control valve 14 according to the invention analogous to FIG. 6*a* with a modified closing body 58. In contrast to the preceding embodiment, here the guide elements 61 constructed as guide bars and the corresponding flattened sections 69 are constructed at a certain angle relative to each other. This has the advantage that the closing body 58 can be mounted only in an exact orientation in the second annular groove 44. Thus, incorrect orientation of the closing body 58 is ruled out.

Figure 7B:
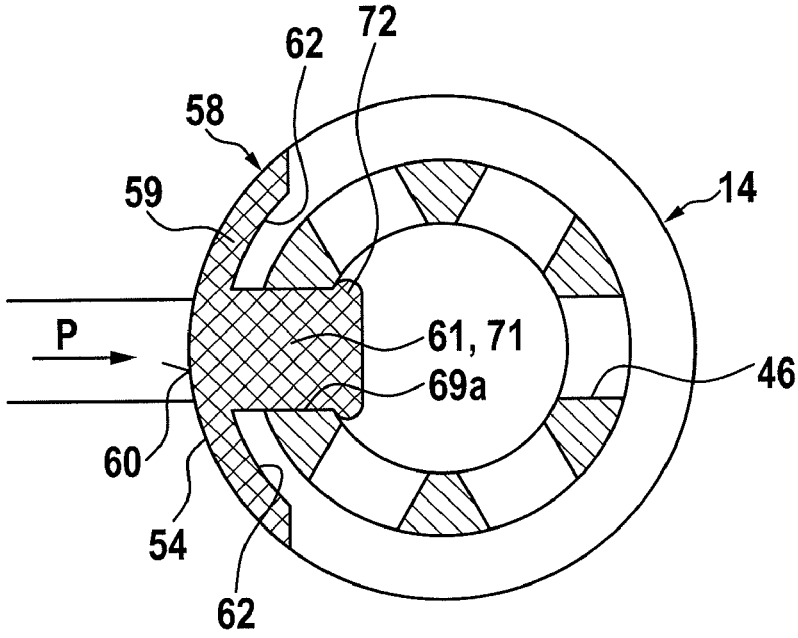

FIG. 7*b* shows another diagram of a control valve 14 according to the invention analogous to FIG. 6*b* with another modified closing body 58. The guide element 61 is constructed in this case as a pin 71 that is arranged centrally on the reverse side of the blocking body 59. The pin 71 engages in one of the first radial openings 46 of the second annular groove 44. Here, an annular wall 69*a* of the radial opening 46 acts as a guide surface for the closing body 58. In order to guarantee the correct orientation of the closing body 58 during assembly, advantageously the radial opening 46 designed for guiding the closing body 58 is larger than the remaining radial openings 46 and the pin 71 is adapted to the dimensions of the larger of the radial openings 46. In order to guarantee a secure closing of the check valve 54, the outer lateral surface of the pin advantageously has a profiled construction. In this way, pressurized medium can flow through the radial opening 46 holding the pin 71 and flow against the blocking body 59.

At the end of the pin 71 facing away from the blocking body 59, an annular, peripheral bead 72 that acts as a holding element is attached to this end.

In addition to the arrangement of the closing body 58 in the second annular groove 44 between the valve housing 41 and a peripheral construction 65, it is naturally also conceivable to arrange these within the fourth annular groove 57 between the control piston 42 and the valve housing 41. This can be realized, for example, in the embodiment of a control valve 14 shown in JP 07-229408.

Figure 8:
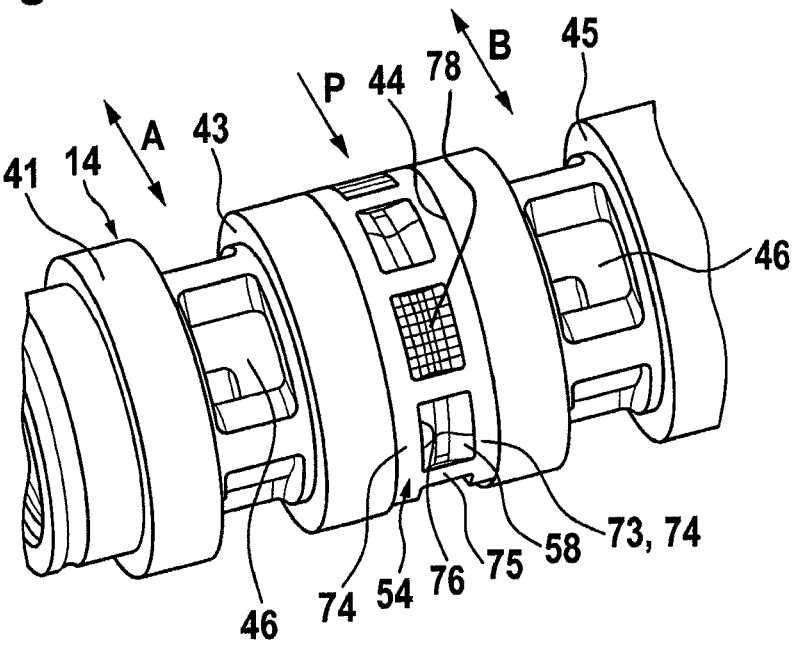
Figure 9:
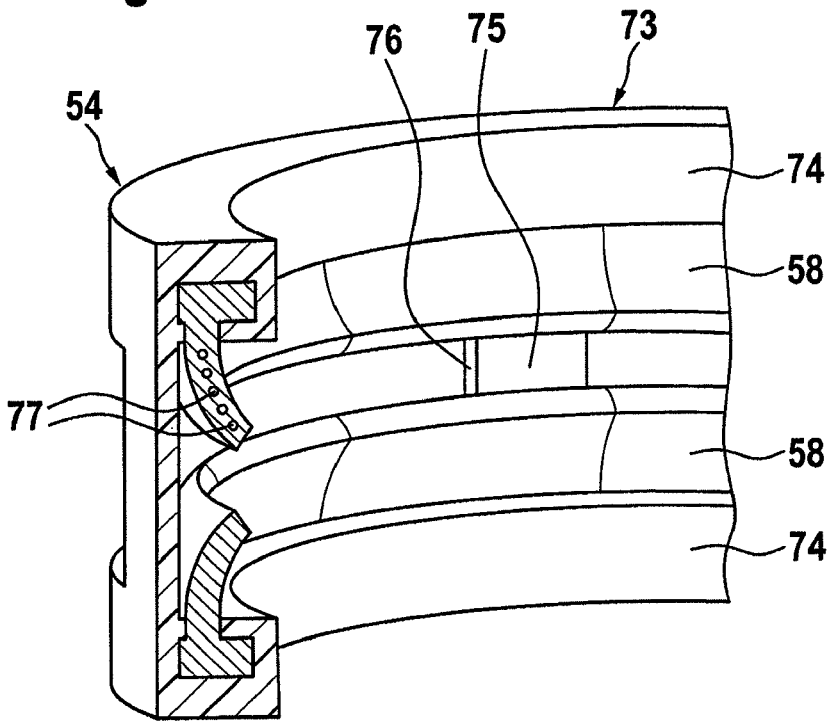

FIG. 8 shows another embodiment according to the invention of a control valve 14 with another variant of a check valve 54. FIG. 9 shows the check valve 54 in a perspective, partially sectioned diagram. The check valve 54 is made from a rigid frame 73 and two flexible closing bodies 58.

The frame 73 has two annular sections 74 that are connected to each other by several support braces 75. The support braces 75 are separated from each other by several recesses 76 spaced apart in the peripheral direction. The extent of the frame 73 in the axial direction corresponds to the extent of the second annular groove 44. In this way it is guaranteed that the frame 73 contacts in a pressure-tight way on the annular surfaces defining the second annular groove 44 and thus the pressurized medium flow can be performed only via the recesses 76. In addition, the frame 73 extends in the peripheral direction along the entire second annular groove 44. In the radial direction within the support braces 75 there are two flexible closing bodies 58. Each closing body 58 is constructed as an annular, bent strip that circulates along the entire inner peripheral surface of the frame 73. Each axial side of the closing body 58 is held in the frame 73 and connected rigidly to this frame. This can be realized, as shown in the figure, by a positive-fit or, for example, by partial encasing of the closing body 58 during the production of the frame 73.

Below, the action of the check valve 54 will be explained. For the flow of pressurized medium into the interior of the control valve 14, the flexible closing bodies 58 are forced radially inward, by which the recesses 76 are opened.

For the reverse pressurized medium flow, the closing bodies 58 are forced against the support braces 75, by which the closing bodies 58 come to lie one on the other and block the recesses 76.

In addition, reinforcement braces 77 that prevent the closing bodies 58 being compressed by the recesses 76 can be provided in the closing bodies 58. These reinforcement braces 77 are advantageously oriented in the peripheral direction so that they do not prevent opening of the closing body 58. In this embodiment of a check valve 54, the recesses 76 can be provided with a filter cloth 78. This can be encased in the frame, for example, during the production of this frame 73. In this way, the functions of an annular filter and those of a check valve 54 can be combined in one component. The filter cloth 78 is shown in FIG. 8 for reasons of clarity only in one of the recesses 76. In order to satisfy the filter function, it is naturally also provided in all of the recesses 76.

The formation of the check valves 54 according to one of the embodiments shown above has the advantage that these are arranged within an annular groove 44 of the control valve 14 and thus require no additional installation space. The check valves 54 can be mounted easily, wherein it is ensured that during the mounting of the control valve 14, the function of the check valves 54 is not negatively affected. In addition, all of the constructions are conceivable as plastic injection-molded parts with an integrated filter function.

Figure 10:
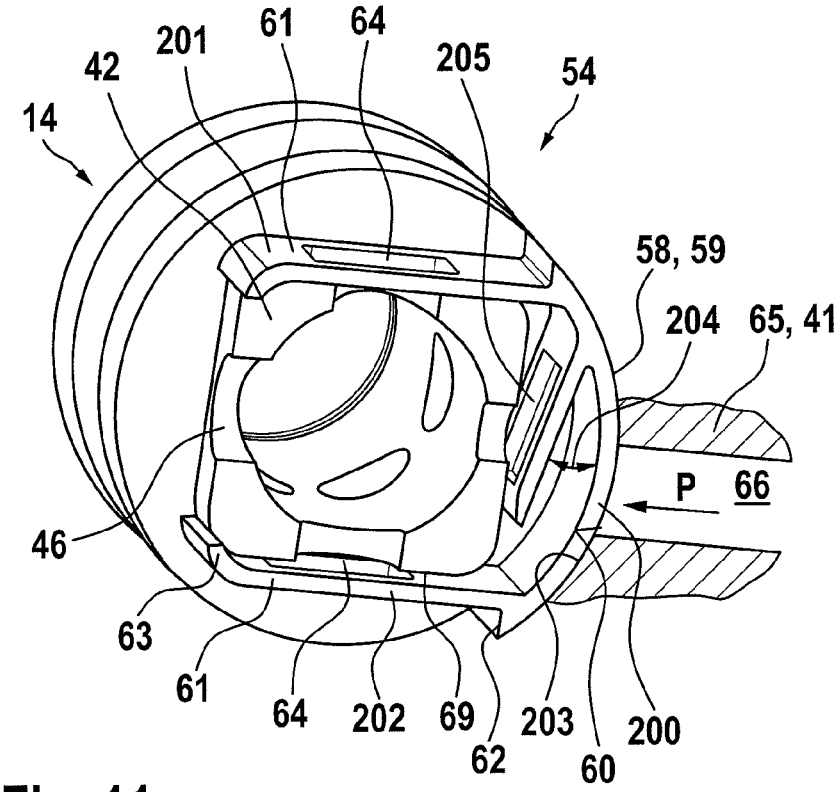
Figure 11:
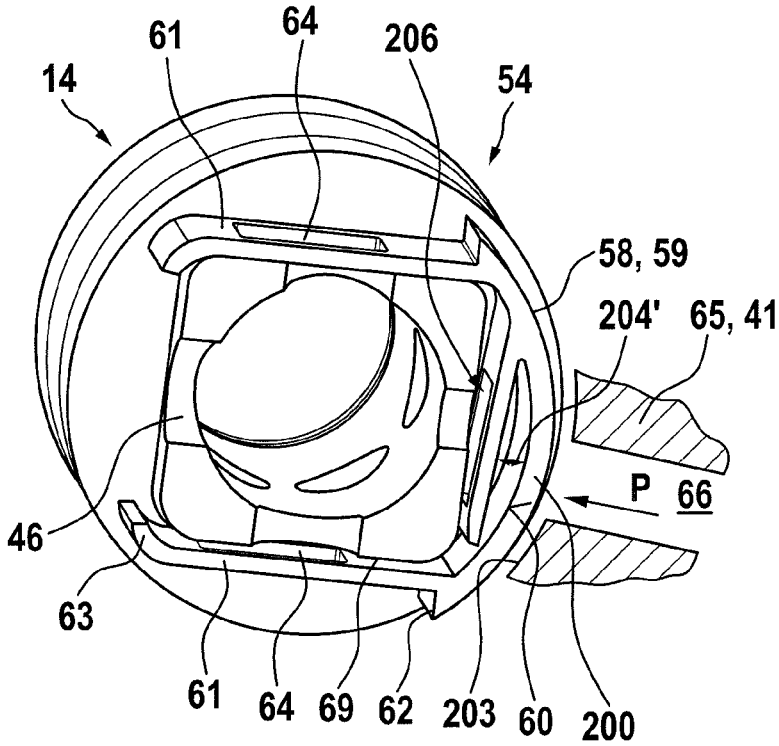
Figure 12:
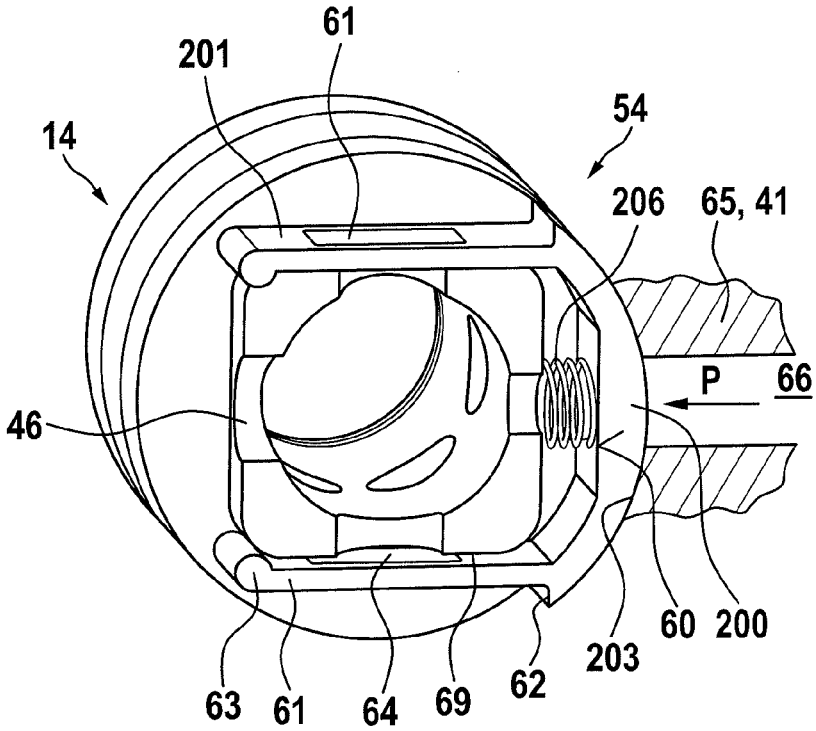

The embodiments shown in FIGS. 10 to 12 of a control valve 14 with a closing body 58 essentially correspond to the embodiment shown in FIGS. 6*a* and 6*b*. The closing body 58 has an essentially U-shaped construction with a base leg 200 and two approximately parallel side legs 201, 202. The base leg 200 is curved according to the recess 203 of the valve housing 41. The side legs 201, 202 form the guide elements 61 that contact the flattened sections 69 of the control piston 42 and have tabs 63 in the end region opposite the base leg 200. A spring bar 205 whose end region is supported on the control piston 42 extends from the base leg 200 as a spring element 206 at an acute angle 204. The spring bar 205 extends for the illustrated embodiment approximately ⅓ to ⅔ of the base leg 200 for a projection on this leg. The spring bar 205 is constructed as an integral component of the closing body 58. For this purpose, elastic components, anchors, or the like can be integrated in the closing body 58. In addition, the spring bar 205 can have through-flow openings.

FIG. 10 shows the spring bar 205 at an angle 204 in the closing position in which the blocking body 59 contacts tight against the recess 206 and thus closes this opening in the region of the boundaries of the opening 67.

Deviating from this configuration, in FIG. 11 the closing body is in an open position for which the base leg 200 is shifted inward in the radial direction toward the longitudinal axis of the control piston 42. Such a shift is accompanied by elastic deformation of the spring bar 205 that leads to a reduction of the angle 204 to an angle 204'.

For an alternative construction according to FIG. 12, the spring element 206 is constructed as a spiral compression spring 206 instead of the spring bar 205.

Figure 13:
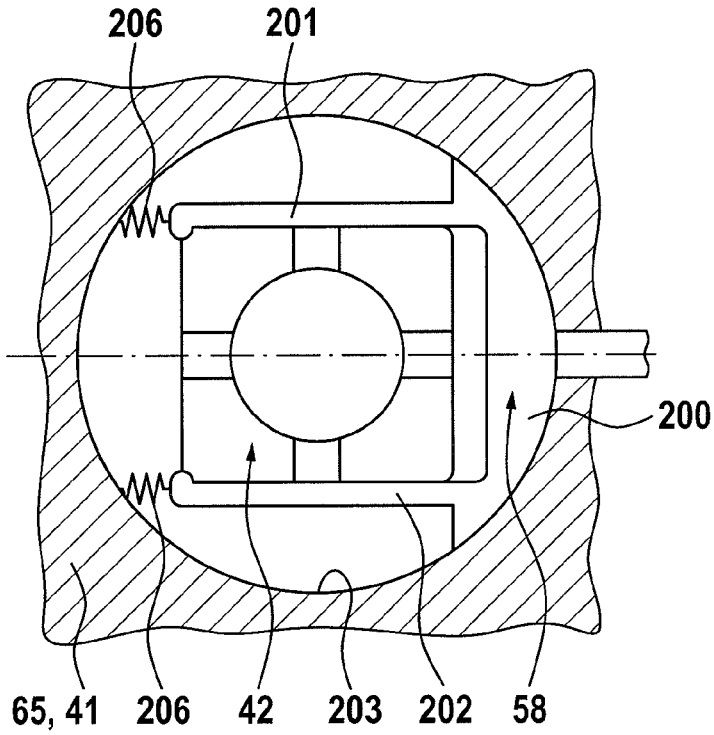

As can be seen from FIG. 13, spring elements 206 can also be supported between the end regions of the side legs 201, 202 opposite the base leg 200 and the recess 203 of the valve housing 41.

Figure 14:
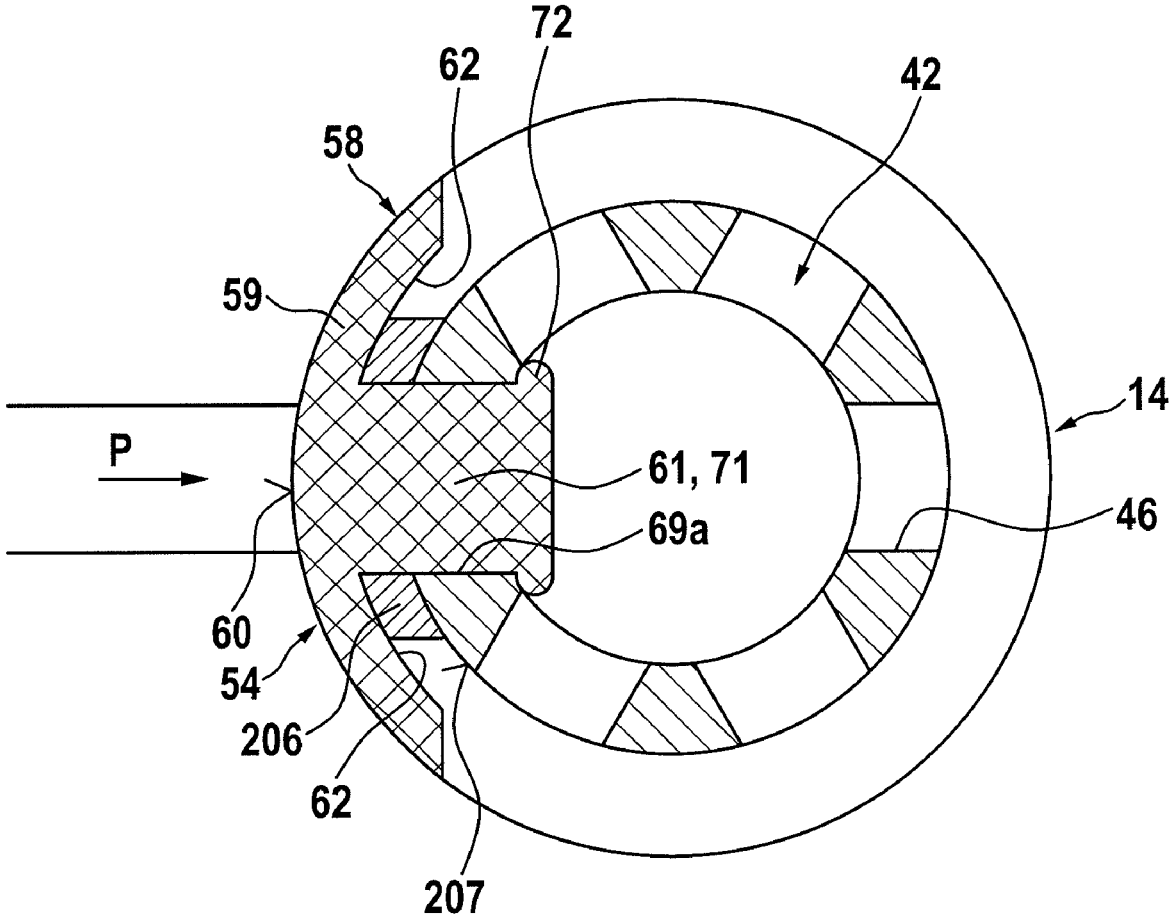

FIG. 14 shows a construction essentially corresponding to FIG. 7*b* for which, however, a spring element 206 is arranged between the blocking body 59 and an outer lateral surface 207 of the control piston 42. This spring element can be constructed, for example, as an elastomer body or as a spiral-shaped compression spring and surrounds the guide element 61 or the pin 71.

For the embodiments shown in FIGS. 10 to 12, the closing body 58 is clipped onto the control piston 42.

LIST OF REFERENCE SYMBOLS

1 Device
1*a* Control device
2 Stator
3 Rotor
4 Drive wheel
5 Recesses
6 Side wall
7 First side cover
8 Second side cover
9 Connection element
10 Vane groove
11 Vane
12 First pressure chamber
13 Second pressure chamber
14 Control valve
15 Leaf spring element
16 First pressurized medium line
17 Second pressurized medium line
18 Tank
19 Pressurized medium pump
21 Arrow
22 Control unit
41 Valve housing
42 Control piston
43 First annular groove
44 Second annular groove
45 Third annular groove
46 First radial openings
46*a* Second radial openings
47 Spring element
48 Push rod
49 First end stop
50 Second end stop
51 First annular bar
52 Second annular bar
53 Control edge
54 Check valve
57 Fourth annular groove
58 Closing body
59 Blocking body
60 Sealing surface
61 Guide element
62 Incident-flow surfaces
63 Tab
64 Through-flow opening
65 Peripheral construction
66 Pressurized medium line
67 Opening
68 Groove base
69 Flattened sections
69*a* Wall
70 Mounting flange
71 Pin
72 Bead
73 Frame
74 Annular section
75 Support braces
76 Recesses
77 Reinforcement braces
78 Filter cloth
100 Internal combustion engine
101 Crankshaft
102 Piston
103 Cylinder
104 Traction mechanism drive
105 Traction mechanism drive
106 Intake camshaft
107 Exhaust camshaft
108 Cam
109 Cam
110 Intake gas exchange valve
111 Exhaust gas exchange valve
P Supply connection
T Tank connection
A First working connection
B Second working connection
200 Base leg
201 Side leg
202 Side leg
203 Recess
204 Angle
205 Spring bar
206 Spring element
207 Lateral surface

The invention claimed is:

1. Control valve for a device for the variable setting of control times of gas exchange valves of an internal combustion engine comprising:

a) a valve housing with a recess oriented in a direction of a longitudinal axis, b) a control piston arranged so that it can move in the recess of the valve housing into different operating positions and c) at least one radial recess formed on at least one of the valve housing or the control piston, wherein, in selected operating positions, the radial recess forms a pressurized medium connection with an opening of the valve housing opening into the recess and d) a closing body which forms a check valve in connection with the opening wherein, in a closed position of the check valve, the closing body closes the opening, and in an open position of the check valve, the closing body releases the opening, e) the closing body has at least one guide element and also a blocking body and, for movement of the closing body between the open and the closed positions, the guide element and the blocking body are moved in common, wherein the closing body slides in a direction of the guide element between the open and closed positions in a direction substantially perpendicular to the longitudinal axis, and f) a spring element is provided that loads the closing body in a radial direction and also in a direction of the closed position.

2. Control valve according to claim 1, wherein the spring element is a spiral spring.

3. Control valve according to claim 1, wherein the spring element is an integral component of the closing body.

4. Control valve for a device for variable setting of control times of gas exchange valves of an internal combustion engine comprising:

a) a valve housing with a recess oriented in a direction of a longitudinal axis, b) a control piston arranged so that it can move in the recess of the valve housing into different operating positions and c) at least one radial recess formed on at least one of the valve housing or the control piston, wherein, in selected operating positions, the radial recess forms a pressurized medium connection with an opening of the valve housing opening into the recess and d) a closing body which forms a check valve in connection with the opening wherein, in a closed position of the check valve, the closing body closes the opening, and in an open position of the check valve, the closing body releases the opening, e) the closing body has at least one guide element and also a blocking body and, for movement of the closing body between the open and the closed positions, the guide element and the blocking body are moved in common, where the closing body has an approximately U-shaped construction with a base leg and two parallel side legs, wherein the base leg forms the blocking body and, at least one side leg forms the guide element that contacts a guide surface of the control piston in a guiding manner, and f) a spring element is provided that loads the closing body in a radial direction and also in a direction of the closed position.

5. Control valve according to claim 4, wherein an elastic sealing element is formed in a region of the base leg.

6. Control valve according to claim 4, wherein a spring bar with which the closing body is supported elastically relative to the control piston projects from the base leg inward at an acute angle.

7. Control valve according to claim 4, wherein at least one of the side legs has a tab that forms a lock or a stop with the control piston in an end region opposite the base leg.

8. Control valve according to claim 4, wherein at least one of the side legs has a through-flow opening.

* * * * *